US011438710B2

(12) United States Patent
Sabin et al.

(10) Patent No.: US 11,438,710 B2
(45) Date of Patent: Sep. 6, 2022

(54) CONTEXTUAL GUIDANCE FOR HEARING AID

(71) Applicant: Bose Corporation, Framingham, MA (US)

(72) Inventors: Andrew Todd Sabin, Chicago, IL (US); Michelle Lee Daniels, Framingham, MA (US)

(73) Assignee: Bose Corporation, Framingham, MA (US)

( * ) Notice: Subject to any disclaimer, the term of this patent is extended or adjusted under 35 U.S.C. 154(b) by 460 days.

(21) Appl. No.: 16/436,218

(22) Filed: Jun. 10, 2019

(65) Prior Publication Data

US 2020/0389740 A1 Dec. 10, 2020

(51) Int. Cl.
*H04R 25/00* (2006.01)

(52) U.S. Cl.
CPC ..... *H04R 25/505* (2013.01); *H04R 25/558* (2013.01); *H04R 25/604* (2013.01); *H04R 25/70* (2013.01); *H04R 25/554* (2013.01); *H04R 2225/41* (2013.01); *H04R 2225/43* (2013.01); *H04R 2225/55* (2013.01); *H04R 2460/07* (2013.01)

(58) Field of Classification Search
CPC .... H04R 25/30; H04R 25/505; H04R 25/507; H04R 25/552; H04R 25/554; H04R 25/558; H04R 25/70; H04R 2225/39; H04R 2225/41; H04R 2225/43; H04R 2225/55; H04R 2460/07
See application file for complete search history.

(56) References Cited

U.S. PATENT DOCUMENTS

| | | | | |
|---|---|---|---|---|
| 6,035,050 | A * | 3/2000 | Weinfurtner | H04R 25/507 381/313 |
| 2010/0329490 | A1* | 12/2010 | Van Schijndel | H04R 25/70 381/314 |
| 2014/0355798 | A1* | 12/2014 | Sabin | H04R 25/70 381/314 |
| 2015/0172831 | A1* | 6/2015 | Dittberner | H04R 25/70 381/314 |
| 2015/0271607 | A1* | 9/2015 | Sabin | H04R 25/30 381/314 |
| 2015/0271608 | A1* | 9/2015 | Sabin | H04R 25/70 381/314 |

(Continued)

FOREIGN PATENT DOCUMENTS

| | | |
|---|---|---|
| EP | 2549397 A1 | 1/2013 |
| EP | 2884766 A1 | 6/2015 |
| EP | 3120578 A1 | 1/2017 |

OTHER PUBLICATIONS

PCT International Search Report and Written Opinion for International Application No. PCT/US2020/036647, dated Sep. 18, 2020, 10 pages.

*Primary Examiner* — Huyen D Le
(74) *Attorney, Agent, or Firm* — Hoffman Warnick LLC

(57) ABSTRACT

Various implementations include control mechanisms for managing hearing aid usage. In some cases, an interface with a representation of the hearing aid in space is used to control audio functions in the device. In other cases, directionality of the device is controlled based upon the user's visual focus direction. In additional cases, the operating mode of the device is adjustable based upon the signature of a nearby acoustic signal.

15 Claims, 6 Drawing Sheets

(56) References Cited

U.S. PATENT DOCUMENTS

| | | | | |
|---|---|---|---|---|
| 2019/0035397 | A1 | 1/2019 | Reily et al. | |
| 2020/0125317 | A1 | 4/2020 | Sabin et al. | |
| 2020/0128322 | A1 | 4/2020 | Sabin et al. | |
| 2020/0322735 | A1* | 10/2020 | Mosgaard | H04R 25/505 |
| 2021/0019109 | A1* | 1/2021 | Smith | H04S 7/304 |

* cited by examiner

Mappings Table 600

| Contextual Cue(s) | Usage Recommendation | Follow-up | Priority |
|---|---|---|---|
| - Device is on-head<br>- No audio playback<br>- Noisy environment<br>- Directivity is on | It seems you may be having a conversation in a noisy environment; consider stepping closer to hear the speaker | Prompt or initiate additional usage tips | Med |
| - Device is on-head<br>- No audio playback<br>- Noisy environment<br>- Directivity is off | In noisy environments like this, Focused Mode will help you hear people speaking in front of you; Tap,(or nod, or voice response) to turn on Focused mode | Switch to Focused Mode | Med-High |
| - Off-head count indicates repeated physical adjustment | If you are having trouble with device fit, consider re-mounting or adjusting fit insert(s) | Prompt or initiate request for feedback | High |

FIG. 6

CONTEXTUAL GUIDANCE FOR HEARING AID

TECHNICAL FIELD

This disclosure generally relates to audio devices. More particularly, the disclosure relates to approaches for providing user guidance with hearing aids.

BACKGROUND

Hearing assistance devices (sometimes referred to as conversation assistance devices, or more commonly, hearing aids) aim to make conversations more intelligible and easier to understand. These devices aim to reduce unwanted background noise and reverberation. While these devices can significantly enhance the day-to-day experience of users with mild to moderate hearing impairment, many users do not realize the full potential of such devices. Many hearing aid users rely upon consultation with an audiology professional to set and/or adjust device settings, develop usage patterns and discuss usage tips. However, in direct-to-consumer scenarios, the user is much less likely to consult with an audiology professional regarding the hearing aid. In these cases, users may fail to realize the beneficial capabilities of these devices, e.g., in dynamic environments.

SUMMARY

All examples and features mentioned below can be combined in any technically possible way.

Various implementations include providing usage recommendations for hearing assistance devices (or, hearing aids) and updating device usage recommendation mappings based upon user feedback. In some cases, hearing aids are configured with usage recommendation capabilities. In other cases, a system including a hearing aid and a connected smart device is configured to provide usage recommendations and update device usage recommendation mappings based upon user feedback.

In some particular aspects, a computer-implemented method includes: providing a device usage recommendation to a user of a hearing aid based upon at least one of: an operating state of the hearing aid, a usage pattern for the hearing aid, or a characteristic of ambient acoustic signals detected at the hearing aid; at least one of: requesting feedback from the user about the device usage recommendation, or detecting a device usage adjustment at the hearing aid; and in response to receiving the feedback from the user or detecting the device usage adjustment, updating a set of device usage recommendation mappings.

In other particular aspects, a hearing aid includes: an acoustic transducer for providing an audio output; at least one microphone for detecting ambient acoustic signals; and a control circuit coupled with the acoustic transducer and the at least one microphone, the control circuit configured to: provide a device usage recommendation to the user based upon at least one of: an operating state of the hearing aid, a usage pattern for the hearing aid or a characteristic of the ambient acoustic signals detected by the at least one microphone; at least one of: request feedback from the user about the device usage recommendation, or detect a device usage adjustment at the hearing aid; and in response to receiving the feedback from the user or detecting the device usage adjustment, update a set of device usage recommendation mappings.

In additional particular aspects, a system includes: a smart device; and a hearing aid connected with the smart device, the hearing aid including: an acoustic transducer for providing an audio output; at least one microphone for detecting ambient acoustic signals; and a control circuit coupled with the acoustic transducer and the at least one microphone, the control circuit configured to: provide a device usage recommendation to the user based upon at least one of: an operating state of the hearing aid, a usage pattern for the hearing aid, or a characteristic of the ambient acoustic signals detected by the at least one microphone; at least one of: request feedback from the user about the device usage recommendation, or detect a device usage adjustment at the hearing aid; and in response to receiving the feedback from the user or detecting the device usage adjustment, update a set of device usage recommendation mappings.

In other particular aspects, a computer-implemented method includes providing a device usage recommendation to a user of a hearing aid based upon at least one of: an operating state of the hearing aid, a usage pattern for the hearing aid, or a characteristic of ambient acoustic signals detected at the hearing aid.

Implementations may include one of the following features, or any combination thereof.

In certain implementations, providing the device usage recommendation includes applying the set of device usage recommendation mappings to data about at least one of: the operating state, the usage pattern or the characteristic of the ambient acoustic signals, to select the device usage recommendation.

In certain cases, the device usage recommendation is provided without updating the set of device usage recommendation mappings.

In particular cases, the device usage recommendations include mappings between: at least one of: operating states of the hearing aid, usage patterns for the hearing aid, or acoustic signatures of ambient acoustic signals; and device usage recommendations.

In some aspects, the device usage recommendation includes a suggested corrective action to: improve audibility of target ambient acoustic signals for the user, or enhance performance of the hearing aid.

In particular implementations, the device usage recommendation includes a suggested corrective action to adjust a behavior of the user or adjust a setting on the hearing aid.

In certain cases, the device usage recommendation is provided at a display located on the hearing aid or on a distinct display at a smart device connected with the hearing aid.

In some aspects, the method further includes providing the device usage recommendation to the user based upon a characteristic of the hearing aid as detected by a sensor system. In certain aspects, the sensor system is located at a smart device or at the hearing aid.

In particular implementations, the operating state is defined by at least one of: an on/off state of the hearing aid, or an operating mode of the hearing aid while in the on state, where the operating mode is defined by a time spent in the operating mode and a user adjustment to a setting in the operating mode, and wherein the device usage adjustment comprises a user adjustment between operating modes or a user adjustment to a setting within an operating mode.

In certain cases, the method further includes providing a notification indicating availability of the device usage recommendation, where the notification and the device usage recommendation are provided using at least one of: a visual interface, a tactile interface or an audio interface, and wherein the user provides the feedback at one or more of the visual interface, the tactile interface, the audio interface, or with a gesture-based command.

In some aspects, the ambient acoustic signals are detected by the at least one microphone at the hearing aid or a distinct microphone at a smart device connected with the hearing aid.

In certain cases, the device usage recommendation mappings are further updated based upon usage pattern data for a population of users that are distinct from the user.

Two or more features described in this disclosure, including those described in this summary section, may be combined to form implementations not specifically described herein.

The details of one or more implementations are set forth in the accompanying drawings and the description below. Other features, objects and advantages will be apparent from the description and drawings, and from the claims.

BRIEF DESCRIPTION OF THE DRAWINGS

FIG. 6 shows a portion of a mappings table including example mappings used by a hearing assistance recommendation engine according to various implementations.

Figure 1:
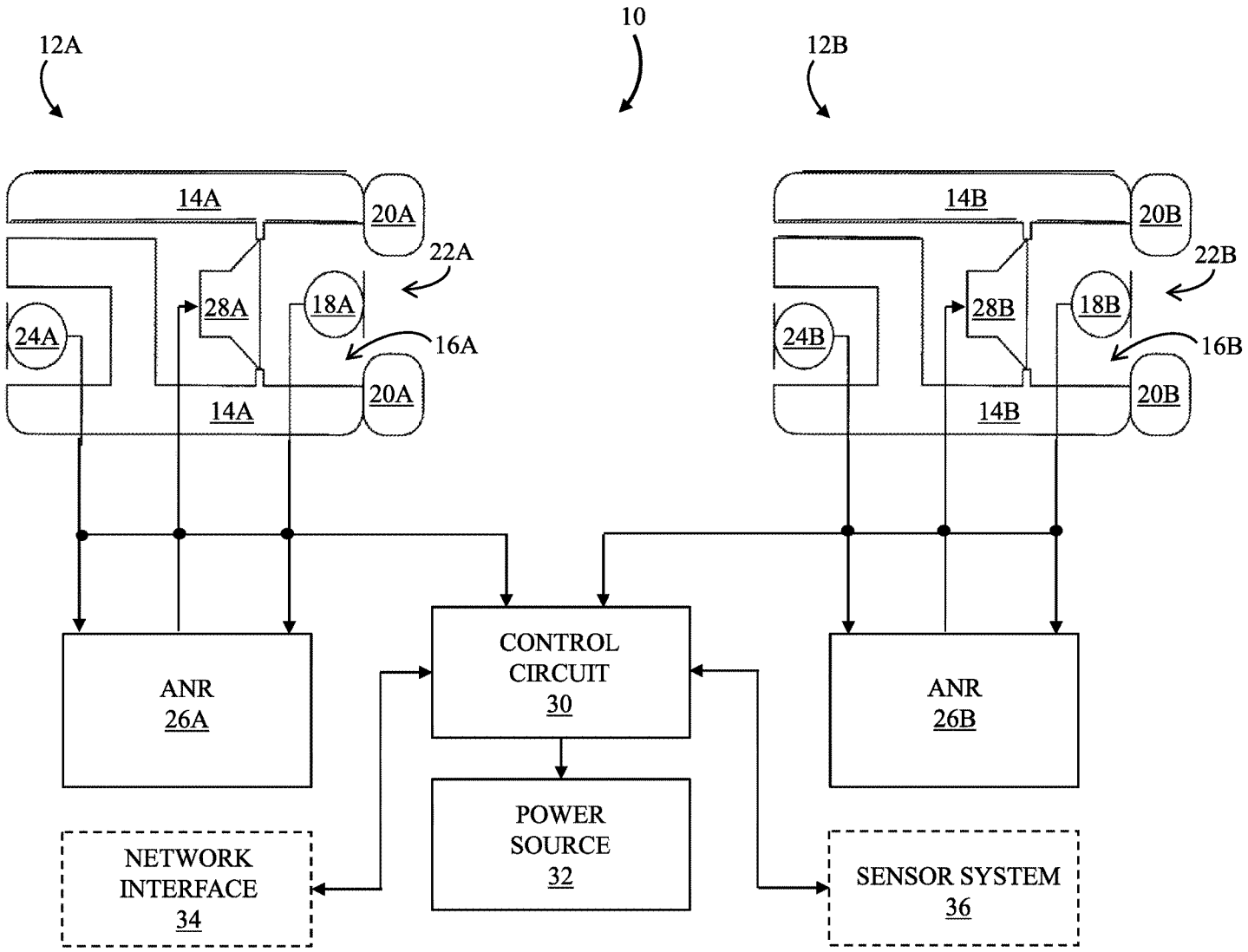
FIG. 1 is a block diagram depicting an example personal audio device according to various disclosed implementations.

It is noted that the drawings of the various implementations are not necessarily to scale. The drawings are intended to depict only typical aspects of the disclosure, and therefore should not be considered as limiting the scope of the implementations. In the drawings, like numbering represents like elements between the drawings.

DETAILED DESCRIPTION

This disclosure is based, at least in part, on the realization that usage recommendations for a hearing assistance audio system (e.g., an audio device such as a hearing aid) can be beneficially presented to a user based upon contextual cues (e.g., in an actual usage environment). For example, contextual cues can include one or more of operating state information or usage pattern(s) for the hearing aid, or characteristic(s) of detected ambient acoustic signals. The device usage recommendations can be refined over time using explicit feedback from the user and/or implicitly by detecting a device usage adjustment (e.g., in response to the recommendation). In some cases, device usage recommendations can be developed and/or refined based upon usage pattern data for a population of users.

Commonly labeled components in the FIGURES are considered to be substantially equivalent components for the purposes of illustration, and redundant discussion of those components is omitted for clarity.

Conventional hearing assistance devices (or, hearing aids) are typically dispensed and adjusted by an audiology professional such as an audiologist in one or more appointments with the user (e.g., in a clinical setting). Interacting with a professional on an in-person basis can give the user confidence in the setup process, and can provide opportunities for refinement of device settings as conditions change or evolve. This consultation also allows the user to learn about how and when device settings should be adjusted, as well as which usage patterns and/or functions can be implemented to improve hearing in dynamic environments. Additionally, the audiologist traditionally provides the user with listening strategies and maintenance strategies of the hearing aid.

However, a portion of the population can benefit from hearing aids, but may not wish to seek professional medical help. For many of these people, direct-to-consumer type hearing aids provide an attractive compromise between seeking professional assistance and receiving no hearing assistance. Despite the benefits of these conventional hearing aids, it can be challenging to personalize the user experience without seeking professional medical help. Examples of conventional hearing assistance devices are described in U.S. Pat. No. 9,560,451 ("Conversation Assistance System"), which is incorporated by reference here in its entirety.

In contrast to conventional hearing aids, various implementations include hearing aids configured for a user with a software module or mobile application that permits the user to adjust the device and improve usage outcomes without needing to consult an audiologist or other hearing assistance professional. That is, the hearing aids disclosed herein can permit the user to adjust the device and improve usage outcomes outside of the clinical setting. The approaches described according to some implementations present a user with a device usage recommendation according to one or more contextual cues. In some cases, the approach can further include detecting a device usage adjustment and/or feedback from the user, and updating a set of device usage recommendation mappings.

It has become commonplace for those who either listen to electronically provided audio (e.g., audio from an audio source such as a mobile phone, tablet, computer, CD player, radio or MP3 player), those who simply seek to be acoustically isolated from unwanted or possibly harmful sounds in a given environment, and those engaging in two-way communications to employ personal audio devices to perform these functions. For those who employ headphones or headset forms of personal audio devices to listen to electronically provided audio, it is commonplace for that audio to be provided with at least two audio channels (e.g., stereo audio with left and right channels) to be separately acoustically output with separate earpieces to each ear. Personal audio devices described herein can utilize various noise reduction approaches. These noise reduction mechanisms can be combined with other audio functions in headphones, such as conversation enhancing functions, for example, as described in U.S. Pat. No. 9,560,451. While the term active noise reduction (ANR) is used to refer to acoustic output of anti-noise sounds, this term can also include controllable noise canceling (CNC), which permits control of the level of anti-noise output, for example, by a user. In some examples, CNC can permit a user to control the volume of audio output regardless of the ambient acoustic volume.

Aspects and implementations disclosed herein may be applicable to a wide variety of personal audio devices including hearing assistance functions, such as wearable audio devices in various form factors, such as watches, glasses, neck-worn speakers, shoulder-worn speakers, body-worn speakers, etc. Unless specified otherwise, the term headphone, as used in this document, includes various types of personal audio devices such as around-the-ear, over-the-ear and in-ear headsets, earphones, earbuds, hearing aids, or other wireless-enabled audio devices structured to be positioned near, around or within one or both ears of a user. Unless specified otherwise, the term wearable audio device, as used in this document, includes headphones and various other types of personal audio devices such as shoulder or body-worn acoustic devices that include one or more acoustic drivers to produce sound without contacting the ears of a user. It should be noted that although specific implementations of personal audio devices primarily serving the purpose of acoustically outputting audio are presented with some degree of detail, such presentations of specific implementations are intended to facilitate understanding through provision of examples, and should not be taken as limiting either the scope of disclosure or the scope of claim coverage.

FIG. 1 is a block diagram of an example of a personal audio device 10 (e.g., a hearing aid) having two earpieces 12A and 12B, each configured to direct sound towards an ear of a user. Features of the personal audio device (also referred to as "audio device") 10 can be particularly useful as a wearable audio device, e.g., a head and/or shoulder-worn hearing assistance device. Reference numbers appended with an "A" or a "B" indicate a correspondence of the identified feature with a particular one of the earpieces 12 (e.g., a left earpiece 12A and a right earpiece 12B). Each earpiece 12 includes a casing 14 that defines a cavity 16. In some examples, one or more internal microphones (inner microphone) 18 may be disposed within cavity 16. An ear coupling 20 (e.g., an ear tip or ear cushion) attached to the casing 14 surrounds an opening to the cavity 16. A passage 22 is formed through the ear coupling 20 and communicates with the opening to the cavity 16. In some examples, an outer microphone 24 is disposed on the casing in a manner that permits acoustic coupling to the environment external to the casing.

In implementations that include noise reduction, the inner microphone 18 may be a feedback microphone and the outer microphone 24 may be a feedforward microphone. In such implementations, each earphone 12 includes an ANR circuit 26 that is in communication with the inner and outer microphones 18 and 24 for controlling noise reduction and/or noise cancelling functions.

A control circuit 30 is in communication with the inner microphones 18, outer microphones 24, and electroacoustic transducers 28, and receives the inner and/or outer microphone signals. In certain examples, the control circuit 30 includes a microcontroller or processor having a digital signal processor (DSP) and the inner signals from the two inner microphones 18 and/or the outer signals from the two outer microphones 24 are converted to digital format by analog to digital converters. In response to the received inner and/or outer microphone signals, the control circuit 30 can take various actions. For example, audio playback may be initiated, paused or resumed, a notification to a wearer may be provided or altered, and a device in communication with the hearing aid may be controlled. In various particular implementations, the outer microphones 24 can include an array of microphones with adjustable directionality for dynamically modifying the "listening direction" of the audio device 10.

The audio device 10 also includes a power source 32. The control circuit 30 and power source 32 may be in one or both of the earpieces 12 or may be in a separate housing in communication with the earpieces 12. The audio device 10 may also include a network interface 34 to provide communication between the audio device 10 and one or more audio sources and other personal audio devices. The network interface 34 may be wired (e.g., Ethernet) or wireless (e.g., employ a wireless communication protocol such as IEEE 802.11, Bluetooth, Bluetooth Low Energy, or other local area network (LAN) or personal area network (PAN) protocols).

Network interface 34 is shown in phantom, as portions of the interface 34 may be located remotely from audio device 10. The network interface 34 can provide for communication between the audio device 10, audio sources and/or other networked (e.g., wireless) speaker packages and/or other audio playback devices via one or more communications protocols. The network interface 34 may provide either or both of a wireless interface and a wired interface. The wireless interface can allow the audio device 10 to communicate wirelessly with other devices in accordance with any communication protocol noted herein. In some particular cases, a wired interface can be used to provide network interface functions via a wired (e.g., Ethernet) connection.

In some cases, the network interface 34 may also include a network media processor for supporting, e.g., wireless streaming of audio, video, and photos, together with related metadata between devices or other known wireless streaming services. As noted herein, in some cases, control circuit 30 can include a processor and/or microcontroller, which can include decoders, DSP hardware/software, etc. for playing back (rendering) audio content at electroacoustic transducers 28. In some cases, network interface 34 can also include Bluetooth circuitry for Bluetooth applications (e.g., for wireless communication with a Bluetooth enabled audio source such as a smartphone or tablet). In operation, streamed data can pass from the network interface 34 to the control circuit 30, including the processor or microcontroller. The control circuit 30 can execute instructions (e.g., for performing, among other things, digital signal processing, decoding, and equalization functions), including instructions stored in a corresponding memory (which may be internal to control circuit 30 or accessible via network interface 34 or other network connection (e.g., cloud-based connection). The control circuit 30 may be implemented as a chipset of chips that include separate and multiple analog and digital processors. The control circuit 30 may provide, for example, for coordination of other components of the audio device 10, such as control of user interfaces (not shown) and applications run by the audio device 10.

In addition to a processor and/or microcontroller, control circuit 30 can also include one or more digital-to-analog (D/A) converters for converting the digital audio signal to an analog audio signal. This audio hardware can also include one or more amplifiers which provide amplified analog audio signals to the electroacoustic transducer(s) 28, which each include a sound-radiating surface for providing an audio output for playback. In addition, the audio hardware may include circuitry for processing analog input signals to provide digital audio signals for sharing with other devices.

The memory in control circuit 30 can include, for example, flash memory and/or non-volatile random access memory (NVRAM). In some implementations, instructions (e.g., software) are stored in an information carrier. The instructions, when executed by one or more processing devices (e.g., the processor or microcontroller in control circuit 30), perform one or more processes, such as those described elsewhere herein. The instructions can also be stored by one or more storage devices, such as one or more (e.g. non-transitory) computer- or machine-readable mediums (for example, the memory, or memory on the processor/microcontroller). As described herein, the control circuit 30 (e.g., memory, or memory on the processor/microcontroller) can include a control system including instructions for controlling hearing assistance functions according to various particular implementations. It is understood that portions of the control system (e.g., instructions) could also be stored in a remote location or in a distributed location, and could be fetched or otherwise obtained by the control circuit 30 (e.g., via any communications protocol described herein) for execution. The instructions may include instructions for controlling hearing assistance functions, as well as digital signal processing and equalization. Additional details may be found in U.S. Patent Application Publication 2014/0277644, U.S. Patent Application Publication 2017/0098466, and U.S. Patent Application Publication 2014/0277639, the disclosures of which are incorporated here by reference in their entirety.

Audio device 10 can also include a sensor system 36 coupled with control circuit 30 for detecting one or more conditions of the environment proximate audio device 10. Sensor system 36 can include one or more local sensors (e.g., inner microphones 18 and/or outer microphones 24) and/or remote or otherwise wireless (or hard-wired) sensors for detecting conditions of the environment proximate audio device 10 as described herein. As described further herein, sensor system 36 can include a plurality of distinct sensor types for detecting conditions proximate the audio device 10. In certain cases, the sensor system 36 can include a microphone array similar to outer microphones 24, or in addition to outer microphones 24 for modifying the listening direction of the audio device 10.

Any microphone described herein as being capable of adjusting directionality can include a plurality of microphones, which may each include a conventional receiver for receiving audio signals (e.g., audio input signals). In some cases, these microphones can include one or more directional microphones. However, in other cases, each microphone in an array can include an omnidirectional microphone configured to be directed by a digital signal processor (DSP), which can be part of control circuit 30. A DSP can be coupled with the microphones (and in some cases, the network interface 34) and include one or more DSP filters for processing audio input and/or audio output in order to control the direction of the microphone array, e.g., by DSP beamforming. DSP beamforming is a known technique for summing the input (e.g., audio input) from multiple directions to achieve a narrower response to input(s) from a particular direction (e.g., left, right, straight ahead, etc.). In some cases the microphone array can include a curved microphone array including a plurality of microphones arranged along an arcuate path, however, in other cases the microphone array can include a linearly arranged set of microphones.

According to various implementations, the hearing aids (which may be, for example, audio device 10 of FIG. 1) described herein can be configured to dynamically adjust the microphone array direction based upon user and/or sensor inputs. These particular implementations can allow a user to experience dynamic, personalized conversation assistance throughout differing acoustic environments. These implementations can enhance the user experience in comparison to conventional conversation assistance systems.

Figure 2:
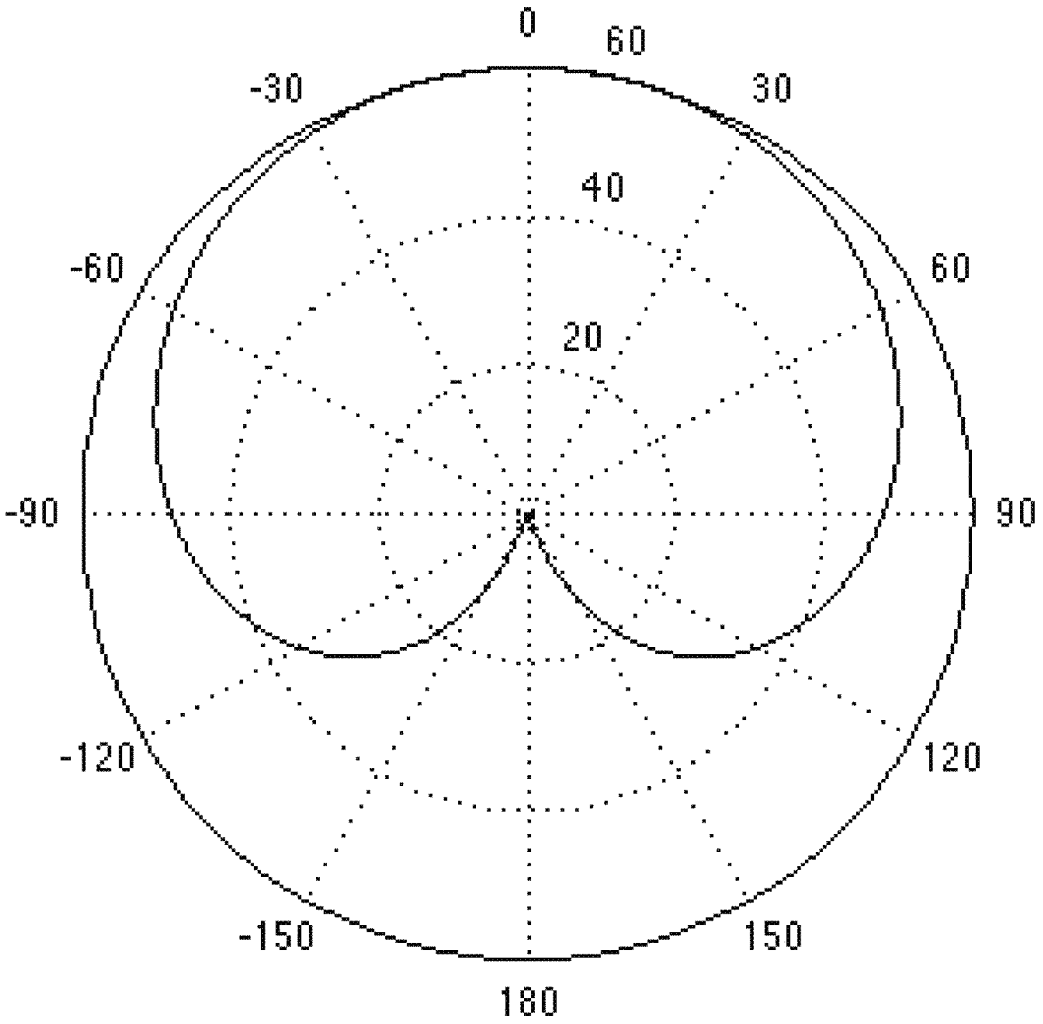
FIG. 2 is a polar graphical depiction illustrating an example response from a given environment at microphones without beamforming.
Figure 3:
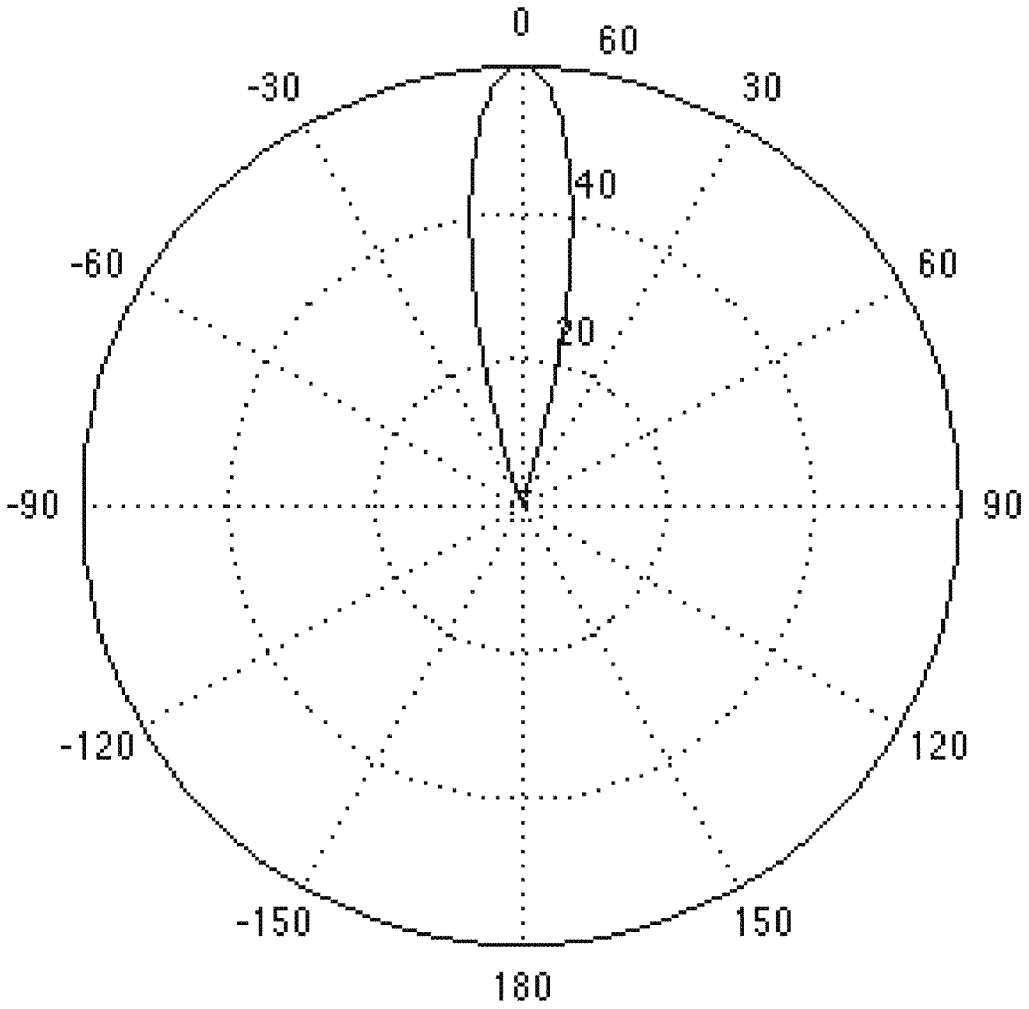
FIG. 3 illustrates a filtered response at microphones from FIG. 2 with digital signal processing (DSP) filters applied to direct a microphone array in a particular direction.

An example response from a given environment (without beamforming) at microphones (e.g., microphones 24, FIG. 1) is shown in the polar graphical depiction of FIG. 2, where the desired pointing direction is called the maximum response angle (MRA), the angle in the polar graph of FIG. 2 is the off-set from that MRA, and the radius is the amplitude response in that MRA direction. FIG. 3 illustrates a filtered response at microphones with DSP filters applied to direct the microphone array in a particular direction (e.g., the MRA direction, which can be dictated by a user command, a direction in which the user is visually focused, a nearby acoustic signal matching a stored acoustic signature, etc.).

In various implementations, the control circuit 30 (FIG. 1) can adjust microphone array directionality, e.g., based upon particular user commands. In particular cases, adjusting the directionality of a microphone array (e.g., microphones 24, FIG. 1) includes adjusting a main lobe angle of the microphone array. The main lobe (or main beam) is the peak point of the array's directivity, and the main lobe angle is the angle of orientation of that peak point relative to the array. In contrast to some conventional systems that adjust the width of array's beam pattern, the control circuit 30 is configured to adjust the main lobe angle of the array in response to user commands.

Figure 4:
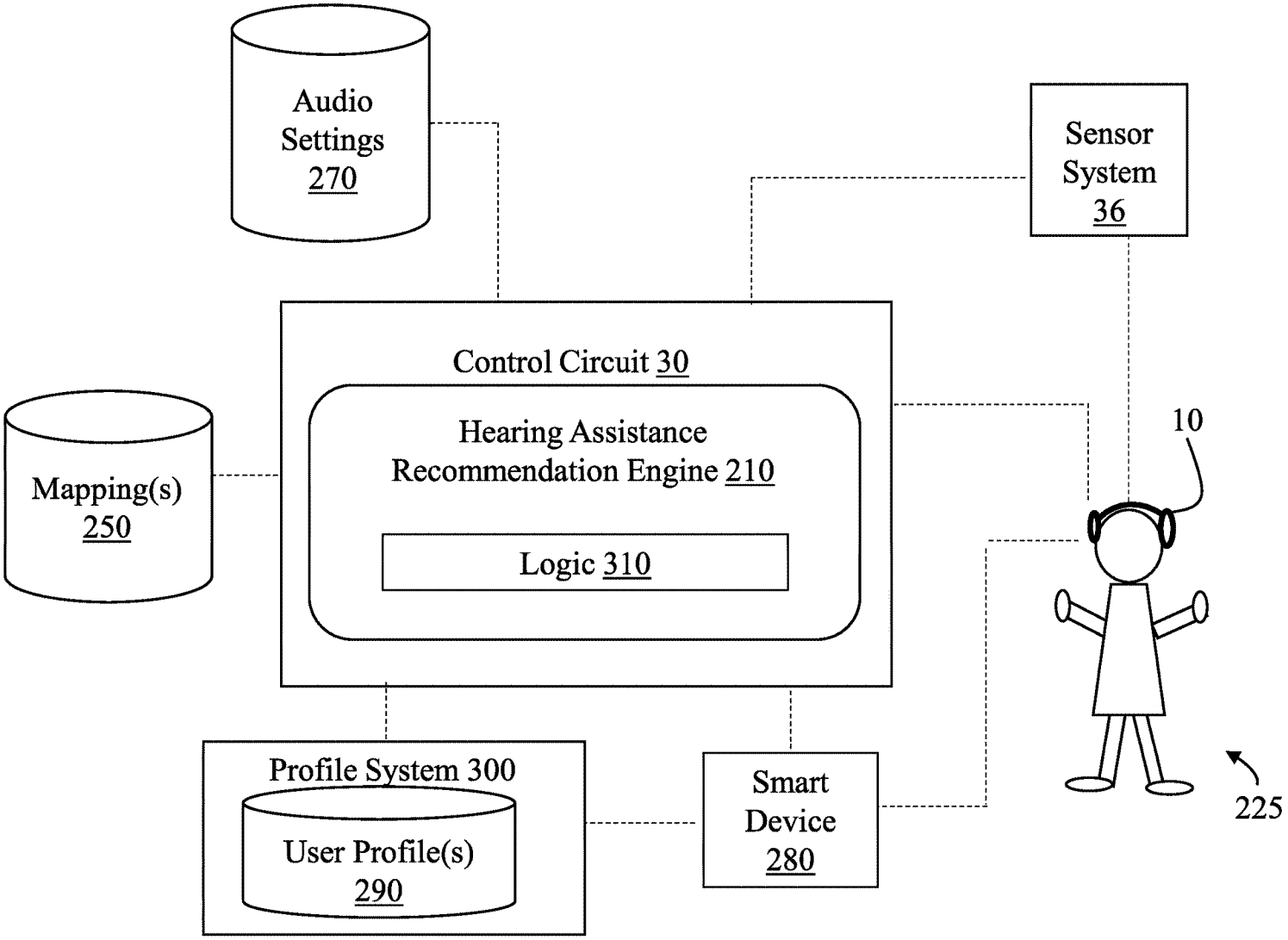
FIG. 4 shows a schematic data flow diagram illustrating control processes performed by a hearing assistance recommendation engine in the personal audio device of FIG. 1.

As described with respect to FIG. 1, control circuit 30 can execute (and in some cases store) instructions for controlling audio functions in audio device 10 and/or a smart device coupled with the audio device 10 (e.g., in a network). As shown in FIG. 4, control circuit 30 can include a hearing assistance recommendation engine 210 configured to implement modifications in audio settings (e.g., settings in ANR circuits 26A,B, FIG. 1) for outputs at the transducer (e.g., speaker) 28 (FIG. 1) based upon user and/or sensor inputs. Additionally, one or more portions of the hearing assistance recommendation engine 210 (e.g., software code and/or logic infrastructure) can be stored on or otherwise accessible to a smart device 280, which may be connected with the control circuit 30 by any communications connection described herein. As described herein, particular functions of the hearing assistance recommendation engine 210 can be beneficially employed on the smart device 280.

With continuing reference to FIG. 4, data flows between hearing assistance recommendation engine 210 and other components in audio device 10 are shown. It is understood that one or more components shown in the data flow diagram may be integrated in the same physical housing, e.g., in the housing of audio device 10, or may reside in one or more separate physical locations.

As noted herein, hearing assistance recommendation engine 210 access, create, modify and/or update recommendation mappings (mappings) 250, which may be stored in a local and/or remote (e.g., cloud or Internet-based) storage system. In some cases, mappings 250 include rules, models, and/or relationships between various contextual inputs and device usage recommendations for the audio device 10. As described herein, these mappings 250 may be part of an artificial neural network (ANN) or other machine learning engine capable of adjustment with training and feedback.

Hearing assistance recommendation engine 210 can also access and control audio setting(s) 270 on the audio device 10. The audio settings 270 can be used to apply different modifications to incoming acoustic signals received at the audio device 10. As described herein, the settings 270 can be adjusted based upon user inputs and/or sensor inputs about the environment proximate the audio device 10. In certain cases, adjusting the audio settings 270 in the audio device 10 can include adjusting one or more of: a directivity of a microphone array in the audio device 10, a microphone array filter on the microphone array in the audio device 10, a volume of audio provided to the user 225 at the audio device 10, parameters controlling wide dynamic range compression or gain parameters controlling the shape of the frequency versus gain function.

As noted herein, hearing assistance recommendation engine 210 can also be coupled with the smart device 280 that has access to one or more user profiles 290 (e.g., in a profile system 300) or biometric information about user 225. It is understood that smart device 280 can include one or more personal computing devices (e.g., desktop or laptop computer), wearable smart devices (e.g., smart watch, smart glasses), a smart phone, a remote control device, a smart beacon device (e.g., smart Bluetooth beacon system), a stationary speaker system, etc. Smart device 280 can include a conventional user interface for permitting interaction with user 225, and can include one or more network interfaces for interacting with control circuit 30 and other components in audio device 10 (FIG. 1).

In some example implementations, smart device 280 can be utilized for: connecting audio device 10 to a Wi-Fi network; creating a system account for the user 225; setting up music and/or location-based audio services; browsing of content for playback; setting preset assignments on the audio device 10 or other audio playback devices; transport control (e.g., play/pause, fast forward/rewind, etc.) for the audio device 10; and selecting one or more audio devices 10 for content playback (e.g., single room playback or synchronized multi-room playback). Smart device 280 can further include embedded sensors for measuring biometric information about user 225, e.g., travel, sleep or exercise patterns; body temperature; heart rate; or pace of gait (e.g., via accelerometer(s)). As noted herein, smart device 280 can be used to provide interface options to the user 225 and/or gather data about acoustic conditions proximate the user 225. Further, it is understood that one or more functions of the hearing assistance recommendation engine 210 can be stored, accessed and/or executed at smart device 280.

User profiles 290 may be user-specific, community-specific, device-specific, location-specific or otherwise associated with a particular entity such as user 225. User profiles 290 can include user-defined playlists of digital music files, audio messages stored by the user 225 or another user, or other audio files available from network audio sources coupled with network interface 34 (FIG. 1), such as network-attached storage (NAS) devices, and/or a DLNA server, which may be accessible to the audio device 10 (FIG. 1) over a local area network such as a wireless (e.g., Wi-Fi) or wired (e.g., Ethernet) home network, as well as Internet music services, which are accessible to the audio device 10 over a wide area network such as the Internet. In some cases, profile system 300 is located in a local server or a cloud-based server, similar to any such server described herein. User profile 290 may include information about audio settings associated with user 225 or other similar users (e.g., those with common hearing attributes or demographic traits), frequency with which particular audio settings are changed by user 225 or other similar users, etc. Profile system 300 can be associated with any community of users, e.g., a social network, subscription-based music service, and may include audio preferences, histories, etc. for user 225 as well as a plurality of other users. In particular implementations, profile system 300 can include user-specific preferences (as profiles 290) for audio settings 270. Profiles 290 can be customized according to particular user preferences, or can be shared by users with common attributes.

Hearing assistance recommendation engine 210 is also configured to receive sensor data from the sensor system 36. Additionally, as noted herein, the hearing assistance recommendation engine 210 can receive sensor data from the smart device 280. This sensor data can be used to control various functions such as ANR (and CNC) functions, dynamic volume control, notifications, etc. In some cases, sensor system 36 can include one or more of the following sensors: a position tracking system; an accelerometer/gyroscope/magnetometer; a microphone (e.g., including one or more microphones, which may include or work in concert with microphones 18 and/or 24); and a wireless transceiver. The sensor system 36 can further include an eye tracking system for detecting the visual focus direction of the user 225, e.g., where the audio device 10 and/or the smart device 280 is a head-worn device with a visual detection system such as an optical eye tracking system. In additional implementations, the sensor system 36 can include a visual detection system such as an optical tracking system that is configured to send visual tracking data about detected movement in an area proximate the user 225 and/or a range of movement of the user 225 (while wearing the audio device 10).

These sensors are merely examples of sensor types that may be employed according to various implementations. It is further understood that sensor system 36 can deploy these sensors in distinct locations and distinct sub-components in order to detect particular environmental information relevant to user 225 and the audio device 10.

A position tracking system can include one or more location-based detection systems such as a global positioning system (GPS) location system, a Wi-Fi location system, an infra-red (IR) location system, a Bluetooth beacon system, etc. In various additional implementations, the position tracking system can include an orientation tracking system for tracking the orientation of the user 225 and/or the audio device 10. The orientation tracking system can include a head-tracking or body-tracking system (e.g., an optical-based tracking system, accelerometer, magnetometer, gyroscope or radar) for detecting a direction in which the user 225 is facing, as well as movement of the user 225 and the audio device 10. The position tracking system can be configured to detect changes in the physical location of the audio device 10 and/or user 225 (where user 225 is separated from audio device 10) and provide updated sensor data to the hearing assistance recommendation engine 210. The position tracking system can also be configured to detect the orientation of the user 225, e.g., a direction of the user's head, or a change in the user's orientation such as a turning of the torso or an about-face movement.

An accelerometer/gyroscope can include distinct accelerometer components and gyroscope components, or could be collectively housed in a single sensor component, e.g., an inertial measurement unit (IMU). This component may be used to sense gestures based on movement of the user's body (e.g., head, torso, limbs) while the user is wearing the audio device 10 or interacting with another device (e.g., smart device 280) connected with audio device 10. As with any sensor in sensor system 36, the accelerometer/gyroscope may be housed within audio device 10 or in another device connected to the audio device 10.

The microphone (which can include one or more microphones, or a microphone array) can have similar functionality as the microphone(s) 18 and 24 shown and described with respect to FIG. 1, and may be housed within audio device 10 or in another device connected to the audio device 10. As noted herein, microphone(s) may include or otherwise utilize microphones 18 and 24 to perform functions described herein. Microphone(s) can be positioned to receive ambient acoustic signals (e.g., acoustic signals proximate audio device 10). In some cases, these ambient acoustic signals include speech/voice input from user 225 to enable voice control functionality. In some other example implementations, the microphone can detect the voice of user 225 and/or of other users proximate to or interacting with user 225. In particular implementations, hearing assistance recommendation engine 210 is configured to analyze one or more contextual cues about the user 225 using mappings 250, provide a device usage recommendation to the user 225 based upon that analysis, receive feedback from the user 225 or sensor data from the sensor system 36 about a usage adjustment at the audio device 10, and (in some cases) update the mappings 250 based upon the feedback and/or the sensor data. In some cases, the hearing assistance recommendation engine 210 can include logic for analyzing sensor inputs, and user feedback as described herein.

As noted herein, the sensor system 36 can also include a wireless transceiver (comprising a transmitter and a receiver), which may include, a Bluetooth (BT) or Bluetooth Low Energy (BTLE) transceiver or other conventional transceiver device. The wireless transceiver can be configured to communicate with other transceiver devices in distinct components (e.g., smart device 280).

It is understood that any number of additional sensors can be incorporated in sensor system 36, and could include temperature sensors or humidity sensors for detecting changes in weather within environments, optical/laser-based sensors and/or vision systems for tracking movement or speed, light sensors for detecting time of day, additional audio sensors (e.g., microphones) for detecting human or other user speech or ambient noise, etc.

According to various implementations, the control circuit 30 includes the hearing assistance recommendation engine 210, or otherwise accesses program code for executing processes performed by hearing assistance recommendation engine 210 (e.g., via network interface 34). Hearing assistance recommendation engine 210 can include logic 310 for processing various inputs. Inputs can include, for example, user interface (UI) inputs from the user 225, operating state data (e.g., from the control circuit 30) about the current operating state of the audio device 10 or changes in operating state over time, and/or usage pattern data about the audio device 10. Additionally, the logic 310 can be configured for deriving and adjusting audio settings 270 according to UI inputs and known characteristics of the acoustic environment (e.g., as detected by the sensor system 36). Logic 310 can also be configured for processing sensor data from the sensor system 36, e.g., data about ambient acoustic signals from microphones, data about a location of the audio device 10, biometric data from a smart device, and/or usage data from a smart device. As noted herein, the logic 310 can also be configured for performing audio control functions according to various implementations.

According to various implementations, the audio device 10 has a predefined set of audio settings 270. In certain cases, these predefined settings 270 are default settings for the audio device 10, e.g., standard settings designed to function most effectively for the population of potential users of audio device 10 and similar devices. In other cases, the predefined settings are saved in the audio device 10 based upon prior usage, e.g., if the user 225 or another prior user of the audio device 10 has already defined settings for the device. In still other cases, the predefined settings are based upon one or more user profile(s) 290, which can be attributed to the user 225 and/or to other users. In certain cases, the profile-based settings can be defined by settings selected or positively verified by a plurality of users in a community or network.

In various particular implementations, the hearing assistance recommendation engine 210 can be configured to provide an interface connected with the audio device 10, e.g., located on the audio device 10 or on another computing device such as the smart device 280. In various implementations, the interface allows the user 225 to receive (e.g., view) device usage recommendations about the audio device 10, as well as provide feedback about the device usage recommendations, to enhance hearing assistance functions.

Figure 5:
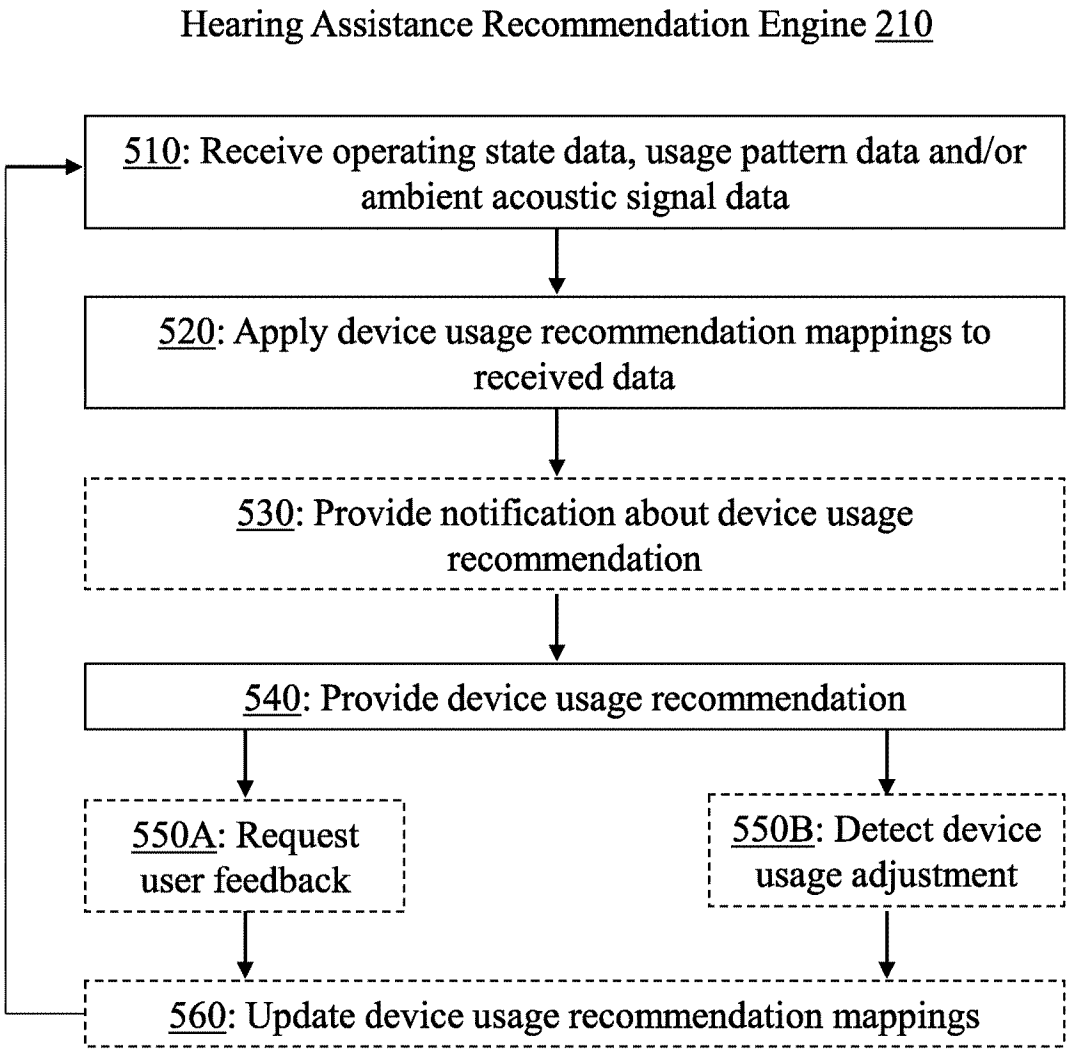
FIG. 5 is a process flow diagram illustrating processes performed by the hearing assistance recommendation engine shown in FIG. 4, according to various implementations.

FIG. 5 is schematic flow diagram illustrating control processes performed by the hearing assistance recommendation engine 210 to interact with the user 225, e.g., providing device usage recommendations and updating corresponding device usage recommendation mappings (e.g., in response to receiving feedback from the 225 user or detecting a device usage adjustment). FIG. 6 show columns and rows from a table 600 illustrating example mappings between contextual inputs and device usage recommendations. The table 600 also illustrates actions taken in response to user acceptance of device usage recommendations, as well as priorities for given device usage recommendations. FIGS. 5 and 6 are referred to simultaneously, along with reference to components shown in FIG. 4.

In various implementations, in process 510, the hearing assistance recommendation engine 210 is configured to receive data about the operating state of the audio device 10 (e.g., from control circuit 30), data about usage pattern(s) of the audio device 10 (e.g., from control circuit 30) and/or data about characteristic(s) of ambient acoustic signals (e.g., from sensor system 36). The hearing assistance recommendation engine 210 can be configured to receive data from the control circuit 30 and/or the sensor system 36 on a periodic or continuous basis.

In process 520, the hearing assistance recommendation engine 210 applies a set of device usage recommendation mappings 250 to the data about at least one of: the operating state, the usage pattern or the characteristic of the ambient acoustic signals, in order to select the device usage recommendation. As noted herein, the device usage mappings 250 can include mappings (or, relationships) between (i) operating states of the hearing aid, (ii) usage patterns for the hearing aid, and/or (iii) acoustic signatures of ambient acoustic signals, with (iv) device usage recommendations. In various implementations, the device usage recommendation includes a suggested corrective action to improve audibility of target ambient acoustic signals for the user 225, or enhance performance of the audio device 10.

As used herein, the operating state of the audio device 10 can be characterized by an on/off state of the audio device 10 and/or an operating mode of the audio device 10 while in the on state. For example, the operating state can be classified by whether the audio device 10 is in the ON state or OFF state, and while ON, the operating state can be further defined by the operating mode of the audio device 10. The audio device 10 can have a plurality of operating modes, such as a playback mode, a focused listening mode, and a general listening mode. Situationally dependent operating modes can also be used, for example, "TV mode", "restaurant mode", "1:1 conversation mode", "quiet mode", etc. The playback mode can include ANR and/or CNC functionality to reduce the impact of ambient acoustic signals while the user 225 listens to audio playback on the audio device 10. For example, playback mode can be desirable when the user 225 is listening to music, a podcast or on a phone call using the audio device 10. Focused listening mode (or Focused Mode) can use microphone array directionality to focus on one or more areas proximate the user 225 (e.g., based upon acoustic signal sources, as described herein). The user 225 can activate focused listening mode, or it can be activated by the hearing assistance recommendation engine 210 based upon sensor inputs (e.g., from sensor system 36). Focused listening mode may employ selective ANR and/or CNC functionality. Various examples of focused listening are described herein. General listening mode (or Everywhere mode) can essentially permit the user 225 to hear all ambient acoustic signals at approximately their naked-ear decibel level. That is, the general listening mode allows the user 225 to hear unobstructed acoustic signals from the environment. In some particular cases, the general listening mode increases the audibility of the acoustic signals based upon the user's level of hearing impairment, e.g., in order to provide audio playback at the audio device 10 at the same level as the received acoustic signals at the outer microphones. Still further operating modes can include left or right mute mode, where the user 225 chooses to cancel signals detected from the left or right side of his/her head, etc.

In various implementations, operating mode is defined by a time spent in the operating mode and a user adjustment to a setting in the operating mode. For example, the hearing assistance recommendation engine 210 is configured to track an amount of time that the user 225 spends in a given operating mode before a transition to another operating mode or operating state (e.g., turning audio device 10 off). Additionally, the hearing assistance recommendation engine 210 is configured to detect user adjustments to settings in each operating mode. For example, the user 225 may choose to increase the World Volume while in a particular operating mode, or increase the playback volume of streamed music or call audio during another operating mode.

As noted herein, the hearing assistance recommendation engine 210 can also be configured to track usage patterns for the audio device 10, e.g., by tracking how long the user 225 keeps the audio device 10 powered, whether he/she consistently adjusts one or more settings 270 when powering the audio device 10 on, whether he/she frequently runs the audio device 10 with low power, whether the battery in the audio device 10 drained while not in use, whether the user 225 frequently adjusts the fit of the audio device 10, etc. These usage patterns can be mapped, either alone or in combination with other pattern data, operating state data and/or data about acoustic signatures of ambient acoustic signals in order to provide device usage recommendations for the user 225. In additional implementations, these usage patterns can be mapped (alone or in combination with other pattern data, operating state data and/or data about acoustic signatures of ambient acoustic signals) for a plurality of users. That is, the hearing assistance recommendation engine can be configured to map usage pattern data (as well as additional data noted herein) for a population of users, and update mappings 250 according to that population data.

As also noted herein, the hearing assistance recommendation engine 210 can be configured to detect and compare characteristics of ambient acoustic signals (e.g., SPL level, acoustic signatures, etc.) with known acoustic signal characteristics to provide device recommendations. For example, the hearing assistance recommendation engine 210 can receive data from one or more microphones at the audio device 10 (e.g., microphones 24), at the sensor system 36 and/or at the smart device 280, such as data about the ambient SPL proximate the user 225 or acoustic signatures of common notifications or alerts (e.g., tonality, sound pressure levels, spectrum, modulation index). In particular cases, the detected acoustic signal has an acoustic signature that indicates a characteristic of the source. For example, the acoustic signature of the detected acoustic signal can indicate the source of the detected acoustic signal is a voice of the user 225, a voice of another user, a notification system or an alert system. In certain cases, the hearing assistance recommendation engine 210 can include a voice recognition circuit for detecting the user's voice and/or differentiating the user's voice from another user's voice.

In various implementations, the device usage mappings 250 are developed and refined according to a number of parameters, many of which include data about one or more of operating state, the usage pattern or the characteristic of the ambient acoustic signals. These parameters can define thresholds for suggesting action, or taking action, according to one or more device usage recommendations. In some examples, parameters include one or more of the following:

A=a number (or range) of consecutive off head records to trigger an auto-power-down suggestion. In various implementations, the control circuit 30 is configured to detect whether the audio device 10 is on the user's head, e.g., with event-based on/off head detection (e.g., as described in U.S. patent application Ser. No. 16/212,040, filed on Dec. 6, 2018 and incorporated by reference herein). Detecting a threshold number of consecutive off head triggers can be mapped to an auto-power-down suggestion. In some cases, on/off head detection is classified as a usage pattern for the audio device 10.

B=a threshold level (e.g., a number or a range of numbers) of sound pressure level (SPL) to indicate a noisy environment. In various implementations, the SPL is detected by the microphones in the sensor system 36, which can be located at the audio device 10 and/or the smart device 280. Where the detected SPL is greater than a threshold level, the environment can be considered noisy. In some cases, threshold SPL is classified as a characteristic of ambient acoustic signals.

C=the threshold level of noise (e.g., wind or other outdoor-associated noise signature) to indicate outdoor environment. In various implementations, microphones can detect noise, and the control circuit 30 analyzes that noise for an acoustic signature matching an outdoor-associated noise such as wind. Where that noise meets a threshold SPL, the audio device 10 is determined to be outdoors or, for example, in another windy environment. In some cases, threshold outdoor-associated noise is classified as a characteristic of ambient acoustic signals.

D=a threshold level of SPL to indicate a quiet environment. Similar to (B), this parameter can include an SPL threshold for defining quiet environments. In some cases, as noted herein, SPL threshold(s) are classified as a characteristic of ambient acoustic signals.

E=a threshold level of SPL to indicate a moderately noisy environment. In some cases, this threshold includes a range that spans between the quiet environment and the noisy environment. In some cases, as noted herein, SPL threshold (s) are classified as a characteristic of ambient acoustic signals.

F=the amount to decrease "world volume" in a noisy environment. World volume can be controlled with noise cancellation (e.g., ANR and/or CNC) approaches described herein. In particular, world volume refers to the level of ambient sound that enters playback at the transducers 28. In a noisy environment, it may be beneficial to reduce the world volume. As noted herein, world volume can be classified as a setting (e.g., in audio settings 270) in one or more operating modes.

G=the amount to increase world volume in a quiet environment. In a quiet environment, it may be desirable to increase world volume to enable the user 225 to hear more from his/her surrounding environment.

H=a minimum voice activity detection (VAD) duration to consider voice level feedback. In some cases, VAD duration is classified as a characteristic of ambient acoustic signals. In various implementations, VAD duration is determined using the computed energy when the user is speaking, as well as the computed energy when the user is not speaking. The VAD duration can indicate when a user's voice level is not appropriate for an environment (e.g., too quiet or too loud).

I=a minimum VAD-related energy to indicate that the voice activity is too loud to be effective. In some cases, VAD energy is classified as a characteristic of ambient acoustic signals.

J=a maximum VAD-related energy to indicate that voice activity is too quiet to be effective.

K=a maximum off head duration that still signifies the audio device 10 is on the user's head (or in the user's ear, in the case of an earbud). In some cases, off head duration is classified as a usage pattern for the audio device 10.

L=a minimum off head duration that still signifies the audio device 10 is not completely off of the user's head (or completely out of the user's ear, in the case of an earbud). In some cases, off head duration is classified as a usage pattern for the audio device 10.

The above-noted parameters are merely examples that can be beneficial in defining device usage recommendation mappings. It is understood that any measurable or detectable parameter (e.g., detectable by the sensor system 36, smart device 280, etc.) can be used in defining and/or refining device usage recommendation mappings. It is further understood that the above-noted parameters can be interrelated in mappings, e.g., to require two or more thresholds to be satisfied in order to make a device usage recommendation.

In various implementations, mappings can define relationships between device usage recommendations and operating states, usage patterns and/or characteristics of ambient acoustic signals. For example, one mapping can include a contextual cue or condition as defined by one or more parameters (e.g., user is in a noisy environment and audio device 10 is in a directional mode such as Focused Mode), and an associated usage recommendation (e.g., deliver a listening strategy recommendation).

Additional example mappings for the audio device 10 are illustrated in example Mapping Table 600 in FIG. 6. As noted herein, various mapping configurations can be used to relate device operating states, usage patterns and ambient acoustic data to device usage recommendations. Table 600 includes a sample of example mappings categorized by Contextual Cue(s), Usage Recommendation, Follow-Up, and Priority. For example, a poor fit mapping can map usage pattern data about off-head duration (or other off-head indicator) with defined thresholds for a set of records (or a period). When these threshold(s) are met, indicating that the audio device 10 is not fit properly, the hearing assistance recommendation engine 210 is configured to provide a device usage recommendation to the user, e.g., via the interface at the audio device 10, smart device 280 or another connected electronic device. The device usage recommendation in this example suggests that the user try re-mounting (or re-fitting) the device or changing the device fitting size (e.g., ear tip or ear cup adjustment). The usage recommendation can also include a cue for providing feedback, or an additional cue such as an audible cue (e.g., audible tone) or tactile cue (e.g., vibration) can notify the user 225 that feedback is requested. In some cases, the user can respond to that cue, e.g., in a similar interface such as on the interface, or using a tactile, voice or gesture-based response. In various implementations, a feedback screen is presented at the interface asking the user 225 whether the usage recommendation was beneficial.

Device usage recommendations can take various forms, and in particular implementations, the device usage recommendation includes a suggestive corrective action to adjust a behavior of the user 225 or adjust a setting on the audio device 10. For example, device usage recommendations can include suggestions to the user 225 to improve his/her experience with the audio device 10. In some cases, device usage recommendations can include device usage suggestions to the user 225 such as suggesting that the user 225 adjust the fit of the audio device 10 to his/her ears. In still other cases, device usage recommendations can include behavioral suggestions such as suggestions that the user 225 move closer to a source of sound that he/she is interested in hearing, or watch the mouth of the person with whom the user 225 is speaking. In other examples, device usage recommendations can include suggestions to adjust a setting (e.g., audio setting(s) 270) on the audio device 10 in order to improve the user experience. For example, these device usage recommendations can include suggestions to adjust a setting within an operating mode (e.g., "Try turning down World Volume"), or suggestions to switch between operating modes (e.g., "Try switching to Focus mode while looking at the person with whom you are speaking").

As is also illustrated in the mappings table 600, each mapping scenario can be assigned a priority, which can be an absolute priority (e.g., highest or lowest) and/or a relative priority (e.g., high v. med. v. low). In some cases, priorities are differentiated by scores, such as on a scale of one to ten. Priority can be used to decide which usage recommendation to provide when contextual cues indicate that more than one usage recommendation can apply. For example, some mappings can have the same set of contextual cues. In these cases, priority can be used to determine which usage recommendation to provide, or in which order (e.g., highest to lowest priority).

Additional example mappings are illustrated in table 600. Various examples include contextual cues related to parameters A-L e.g., omnidirectional outside control can rely in part upon wind noise (parameter C) detected by the sensor system 36, and World Volume control can rely in part upon threshold SPLs (parameters B and D).

Mappings in Table 600 are merely one example of such a configuration. Further, these example mappings can utilize coefficients to define thresholds, as well as customized mappings for particular users.

In additional implementations, a machine learning-based classifier is used for mappings, for example, a classifier that is trained to identify whether a notification should be presented based upon input data available at a given time. In other implementations, mappings 250 can include a model that infers desired device state(s) and user behavior, and either chooses a notification most likely to provide the largest improvement in user experience at a given time or does not provide a notification where the predicted improvement is negligible. In various implementations, this model is configured to learn over time using various inputs, e.g., update desired state given contextual data, update expected effects of a given notification, etc.

Returning to FIG. 5, in various optional implementations, after applying the device usage recommendation mappings to the received contextual data (process 520), the hearing assistance recommendation engine 210 is configured to provide a notification indicating availability of the device usage recommendation (process 530). In these cases, the notification can be provided via any interface described herein, e.g., visual interface, tactile interface and/or audio interface (such as via a vibration on at the audio device 10 or other wearable electronic device (e.g., smart phone 280), via an audible tone or other audio notification at the transducer on the audio device 10, via a visual notification at the interface(s) on the audio device 10 and/or smart device 280, etc.). The notification can indicate that a usage recommendation is available.

It is understood that in some implementations, the device usage recommendation is provided without a notification, e.g., via any interface described herein (process 540), e.g., a visual interface, a tactile interface and/or an audio interface. For example, the device usage recommendation can be provided as an audio output at the transducer(s) on the audio device 10. In other particular examples, the hearing assistance recommendation engine 210 provides the device usage recommendation at a visual interface such as a touch screen or other screen on the smart device 280, and may provide the device usage recommendation in text form, e.g., as illustrated in the example Usage Recommendation column in Mappings Table 600. Providing the device usage recommendation in a visual interface format can be beneficial in various implementations, as the user's ears may already be engaged with the audio interface at the audio device 10 (e.g., listening to music, or attempting to hear another speaker in a conversation). Additionally, providing the device usage recommendation on a display that is distinct from the audio device 10 can increase the likelihood that the user 225 will notice the recommendation, and potentially increase the likelihood of adoption.

After providing the device usage recommendation to the user 225, in some cases, the hearing assistance recommendation engine 210 is configured to request user feedback about the recommendation (process 550A) and/or detect a usage adjustment at the audio device 10 (process 550B) and update the device usage recommendation mappings 250 accordingly (process 560). That is, the hearing assistance recommendation engine 210 can be configured to use feedback from the user 225 and/or a detected adjustment in device usage to update the device usage recommendation mappings 250, e.g., improving the accuracy of mapped relationships between the operating state data, usage pattern data and/or ambient acoustic signal data with device usage recommendations.

In some particular cases, the hearing assistance recommendation engine 210 can prompt the user 225 for feedback about the device usage recommendation, e.g., with a notification via any interface described herein. In some cases, the prompt for feedback can include a notification, such that the user 225 receives one message requesting feedback (e.g., an audio request at the transducers 28, or a text request at the display(s) such as "Was this recommendation helpful?"). In other cases, a notification at the audio device 10 can alert the user 225 to a request for feedback, e.g., where a vibration or an audible tone alerts the user 225 to the existence of the feedback request, but the request for feedback is presented at the display on the smart device 280 (e.g., "Please rate this recommendation?" or, "Would you like to receive more contextual recommendations like this one?). In various implementations, the user 225 can provide feedback about the recommendation at one or more of a visual interface (e.g., via a touch screen command at the audio device 10 and/or smart device 280), a tactile interface (e.g., by double-tapping an interface on the audio device 10), an audio interface (e.g., with a voice command detected at the microphones on the audio device 10 and/or smart device 280), or with a gesture-based command (e.g., a head nod while wearing the audio device 10 or a wrist flip while wearing a smart device 280 attached to the user's wrist).

In additional implementations, the hearing assistance recommendation engine 210 either does not request feedback, or does not receive feedback from the user. In these cases, as well as in cases where feedback is received, the hearing assistance recommendation engine 210 can be configured to detect a device usage adjustment at the audio device 10 in order to aid in updating device usage recommendation mappings. Device usage adjustments can include any detectable change in device usage, which can be logged by the control circuit 30 and/or identified by one or more sensors in the sensor system 36. For example, device usage adjustments can include changing an operating state of the audio device 10 (e.g., On/Off state change), changing an operating mode within the on state (e.g., from Everywhere mode to Focus mode), and/or user behavioral changes (e.g., where the user 225 changes his/her orientation, location and/or look direction, as detected by the sensor system 36.

In some cases, device usage adjustments are detected continuously, or on a periodic basis. In various implementations, the hearing assistance recommendation engine 210 is configured to log or otherwise track these device usage adjustments over time, e.g., for the user 225 and/or a population of users. This device usage adjustment data can be used to update mappings 250, for example, on a personalized basis for the user 225 or according to changes across a population of users. In some particular examples, the hearing assistance recommendation engine 210 can detect that the user 225 makes frequent or significant device usage adjustments (e.g., adjusting the fit of audio device 10, or adjusting the volume of playback), and can adjust mappings 250 to provide tailored recommendations (e.g., to address fit issues by suggesting steps for fitting the audio device 10 and/or related attachments, or to enable dynamic volume settings based upon changes in ambient acoustics).

In additional cases, device usage adjustments are detected within an adjustment period such as a number of seconds after the hearing assistance recommendation engine 210 provides the usage recommendation. The hearing assistance recommendation engine 210 is configured to detect these device usage adjustments, and when performed within an adjustment period (e.g., approximately one or two seconds up to one minute after providing the device usage recommendation), the hearing assistance recommendation engine 210 infers that these device usage adjustments are in response to the recommendation. The hearing assistance recommendation engine 210 can further detect whether the user 225 subsequently adjusts his/her device usage in order to determine if the device usage recommendation was adopted or useful.

Based upon the received feedback and/or the detected device usage adjustments (e.g., within an adjustment period, or over time), in some cases, the hearing assistance recommendation engine 210 is configured to update the device usage recommendation mappings 250 (FIG. 4), as shown in process 560 in FIG. 5. As described with respect to the example mappings in table 600, in various implementations, the hearing assistance recommendation engine 210 is configured to update contextual cue thresholds, as well as relationships between contextual cues and groupings of contextual cues in response to received feedback and/or detected device usage adjustments. Additionally, priorities between distinct recommendations can be adjusted based upon user adoption and/or feedback, e.g., where recommendations with more positive feedback are elevated in priority relative to recommendations with more negative feedback. Even further, some device usage recommendations can be eliminated or reduced in priority where user feedback and/or detected device usage adjustments indicate that users do not adopt those recommendations or do not find the recommendations useful. For example, thresholds for defining quiet environments and/or loud environments can be adjusted based upon whether the user(s) ignore notifications or restore previous settings soon after accepting a device usage recommendation. Additionally, the frequency of notifications can be adjusted based upon the frequency with which the user 225 responds to the notifications (e.g., increasing frequency of notifications where user 225 responds more frequently). In other examples, World Volume settings can be customized for individual users based upon prior user adjustments. In still further examples, high (or relatively higher) priority and/or weighting is assigned to notifications that the user 225 indicates are helpful (e.g., via feedback mechanisms).

In still further implementations, device usage recommendation mappings can be updated based upon population information from a plurality of users 225, e.g., in groups of users with similar responses to device usage recommendations, demographic characteristics, device usage patterns, etc. In these cases, the hearing assistance recommendation engine 210 can be configured to provide device usage recommendations such as, "Users who found advice X helpful also found advice Y helpful." Or, in other cases, mappings are updated based upon contextual cues and user habits, e.g., as part of a model for the user 225 or a group of users. For example, a device usage recommendation can include something similar to, "You usually set setting X (e.g., World Volume) to value Y in this context. Would you like us to make that adjustment now? Would you like that adjustment to be automatic in the future?"

It is understood that updating the mappings 250 as described with reference to process 560 (FIG. 5) is optional in some implementations (as illustrated in phantom). That is, in various implementations, the hearing assistance recommendation engine 210 either does not receive user feedback or detect a device usage adjustment, e.g. the user 225 does not provide feedback or adjust usage of the device 10. In these cases, the hearing assistance recommendation engine 210 may not update the mappings 250 after providing the device usage recommendation. In other cases, the hearing assistance recommendation engine 210 can be configured in a notification-only mode to only provide device usage recommendations based upon current mappings 250, but without updating those mappings 250 based upon the user feedback or detected device usage adjustment.

With reference to FIG. 4, one or more of the logic components described herein can include an artificial intelligence (AI) component for iteratively refining logic operations to enhance the accuracy of its results. Example AI components can include machine learning logic, a neural network including an artificial neural network, a natural language processing engine, a deep learning engine, etc. Logic components described herein (e.g., logic 310) may be connected with other logic and/or data structures (e.g., mappings 250) in such a manner that these components act in concert or in reliance upon one another. In various implementations, the data structures described herein can include one or more relational databases and/or indexed data structures.

The hearing assistance recommendation engine 210 is described in some examples as including logic 310 for performing one or more functions. In various implementations, the logic 310 in hearing assistance recommendation engine 210 can be continually updated based upon data received from the user 225 (e.g., user selections or commands), sensor data received from the sensor system 36, settings 270 updates, updates and/or additions to the mappings 250 and/or updates to user profile(s) 290 in the profile system 300.

In some example implementations, the hearing assistance recommendation engine 210 (e.g., using logic 310) is configured to perform one or more of the following logic processes using sensor data, command data and/or other data accessible via sensor system 36, profile system 300, smart device 280, etc.: speech recognition, speaker identification, speaker verification, word spotting (e.g., wake word detection), speech end pointing (e.g., end of speech detection), speech segmentation (e.g., sentence boundary detection or other types of phrase segmentation), speaker diarization, affective emotion classification on voice, acoustic event detection, two-dimensional (2D) or three-dimensional (3D) beam forming, source proximity/location, volume level readings, acoustic saliency maps, ambient noise level data collection, signal quality self-check, gender identification (ID), age ID, echo cancellation/barge-in/ducking, language identification, and/or other environmental classification such as environment type (e.g., small room, large room, crowded street, etc.; and quiet or loud).

In some implementations, the hearing assistance recommendation engine 210 is configured to work in concert with sensor system 36 to continually monitor changes in one or more environmental conditions. In some cases, sensor system 36 may be set in an active mode, such as where a position tracking system pings nearby Wi-Fi networks to triangulate location of the audio device 10, or a microphone (e.g., microphones 18 and/or 24) remains in a "listen" mode for particular ambient sounds. In other implementations, sensor system 36 and hearing assistance recommendation engine 210 can be configured in a passive mode, such as where a wireless transceiver detects signals transmitted from nearby transceiver devices or network devices. In still other implementations, distinct sensors in the sensor system 36 can be set in distinct modes for detecting changes in environmental conditions and transmitting updated sensor data to hearing assistance recommendation engine 210. For example, some sensors in sensor system 36 can remain in an active mode while audio device 10 is active (e.g., powered on), while other sensors may remain in a passive mode for triggering by an event.

As described herein, user prompts can include an audio prompt provided at the audio device 10 or a distinct device (e.g., smart device 280), and/or a visual prompt or tactile/haptic prompt provided at the audio device 10 or a distinct device (e.g., smart device 280). In some cases, an audio prompt can include a phrase such as, "Would you like to receive contextual recommendations about settings adjustments on your hearing assistance device?," or "Respond with a nod or "yes" to adjust audio settings based upon your detected environment," or, "Take action X to initiate recommended adjustment mode." These are merely examples of audio prompts, and any suitable audio prompt can be used to elicit actuation by the user 225. In other cases, a visual prompt can be provided, e.g., on a smart device 280 or at the audio device 10 (e.g., at a user interface) which indicates that one or more recommendations, operating modes or modifications are available. The visual prompt could include an actuatable button, a text message, a symbol, highlighting/lowlighting, or any other visual indicator capable of display on the audio device 10 and/or the smart device 280. A tactile/haptic prompt can include, e.g., a vibration or change in texture or surface roughness, and can be presented at the audio device 10 and/or smart device 280. This tactile/haptic prompt could be specific to the hearing assistance recommendation engine 210, such that the tactile/haptic prompt is a signature which indicates the operating mode (e.g., personalization mode) or adjustment (e.g., single-command adjustment) is available. As the tactile/haptic prompt may provide less information about the underlying content offered, distinct tactile/haptic prompts could be used to reflect priority, e.g., based upon user profile(s) 290 or other settings.

In some particular implementations, actuation of a prompt can be detectable by the audio device 10, and can include a gesture, tactile actuation and/or voice actuation by user 225. For example, user 225 can initiate a head nod or shake to indicate a "yes" or "no" response to a prompt, which is detected using a head tracker in the sensor system 36. In additional implementations, the user 225 can tap a specific surface (e.g., a capacitive touch interface) on the audio device 10 to actuate a prompt, or can tap or otherwise contact any surface of the audio device 10 to initiate a tactile actuation (e.g., via detectable vibration or movement at sensor system 36). In still other implementations, user 225 can speak into a microphone at audio device 10 to actuate a prompt and initiate the adjustment functions described herein.

In some other implementations, actuation of prompt(s) is detectable by the smart device 280, such as by a display (e.g., touch screen), vibrations sensor, microphone or other sensor on the smart device 280. In certain cases, the prompt can be actuated on the audio device 10 and/or the smart device 280, regardless of the source of the prompt. In other implementations, the prompt is only actuatable on the device from which it is presented. Actuation on the smart device 280 can be performed in a similar manner as described with respect to audio device 10, or can be performed in a manner specific to the smart device 280.

The usage recommendations and adjustment approaches described according to various implementations can significantly improve the user experience when compared with conventional approaches, for example, by closely tailoring the audio settings on the audio device 10 and/or adjusting the user's behavior to improve hearing in different contexts. For example, the usage recommendation and refinement approaches described according to various implementations can have the technical effect of easing user interaction and adoption of the audio device 10 in real-world settings (e.g., in active conversation), and improving hearing/conversation assistance functions during use. Additionally, certain implementations allow the user to change audio settings with intuitive commands, streamlining the process of adjusting settings. Additionally, users can appreciate the ability to tailor device settings and usage habits to different contextual scenarios.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of the calibration process. All or part of the functions can be implemented as, special purpose logic circuitry, e.g., an FPGA and/or an ASIC (application-specific integrated circuit). Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

In various implementations, electronic components described as being "coupled" can be linked via conventional hard-wired and/or wireless means such that these electronic components can communicate data with one another. Additionally, sub-components within a given component can be considered to be linked via conventional pathways, which may not necessarily be illustrated.

A number of implementations have been described. Nevertheless, it will be understood that additional modifications may be made without departing from the scope of the inventive concepts described herein, and, accordingly, other embodiments are within the scope of the following claims.

We claim:

1. A computer-implemented method comprising:

providing a device usage recommendation to a user of a hearing aid based upon at least one of: an operating state of the hearing aid, a usage pattern for the hearing aid, or a characteristic of ambient acoustic signals detected at the hearing aid, wherein the device usage recommendation comprises a suggested corrective action provided as an interface notification to: improve audibility of target ambient acoustic signals for the user, or enhance performance of the hearing aid, and wherein the device usage recommendation is provided during use of the hearing aid by the user;

at least one of: requesting feedback from the user about the device usage recommendation, or detecting a device usage adjustment at the hearing aid;

in response to receiving the feedback from the user or detecting the device usage adjustment, updating a set of device usage recommendation mappings, wherein the device usage recommendation mappings comprise mappings based on detected on-head to off-head and off-head to on-head adjustments; and providing the device usage recommendation to the user based on the mappings as a recommendation to re-mount or adjust fit inserts for the hearing aid in response to detecting an off-head count that exceeds a threshold during a period.

2. The computer-implemented method of claim 1, wherein providing the device usage recommendation comprises applying the set of device usage recommendation mappings to data about at least one of: the operating state, the usage pattern or the characteristic of the ambient acoustic signals, to select the device usage recommendation, wherein the device usage recommendations comprise mappings between:

at least one of: operating states of the hearing aid, usage patterns for the hearing aid, or acoustic signatures of ambient acoustic signals; and device usage recommendations.

3. The computer-implemented method of claim 1, wherein the device usage recommendation comprises a suggested corrective action to adjust a behavior of the user or adjust a setting on the hearing aid, wherein the device usage recommendation mappings are further updated based upon usage pattern data for a population of users distinct from the user, and wherein the device usage recommendation mappings are updated based on receiving the feedback from the user or detecting the device usage adjustment during an adjustment period following the providing of the device usage recommendation.

4. The computer-implemented method of claim 3, wherein the device usage recommendation is provided at a display located on the hearing aid or on a distinct display at a smart device connected with the hearing aid during use of the hearing aid by the user.

5. The computer-implemented method of claim 3, wherein the adjustment period is approximately one minute or less.

6. The computer-implemented method of claim 1, further comprising providing the device usage recommendation to the user based upon a characteristic of the hearing aid as detected by a sensor system, wherein the device usage recommendation includes a prompt requesting feedback from the user and is provided to the user via an interface capable of detecting a response from the user with the sensor system.

7. The computer-implemented method of claim 1, wherein the operating state is defined by at least one of: an on/off state of the hearing aid, or an operating mode of the hearing aid while in the on state, wherein the operating mode is defined by a time spent in the operating mode and a user adjustment to a setting in the operating mode, and wherein the device usage adjustment comprises a user adjustment between operating modes or a user adjustment to a setting within an operating mode.

8. The computer-implemented method of claim 1, further comprising providing a notification indicating availability of the device usage recommendation, wherein the notification and the device usage recommendation are provided using at least one of: a visual interface, a tactile interface or an audio interface, and wherein the user provides the feedback at one or more of the visual interface, the tactile interface, the audio interface, or with a gesture-based command, wherein the notification indicating availability of the device usage recommendation is provided during a period in which active conversation is detected at the hearing aid.

9. A hearing aid comprising:

an acoustic transducer for providing an audio output;

at least one microphone for detecting ambient acoustic signals; and a control circuit coupled with the acoustic transducer and the at least one microphone, the control circuit configured to:

provide a device usage recommendation to a user based upon at least one of: an operating state of the hearing aid, a usage pattern for the hearing aid or a characteristic of the ambient acoustic signals detected by the at least one microphone, wherein the device usage recommendation comprises a suggested corrective action provided as an interface notification to: improve audibility of target ambient acoustic signals for the user, or enhance performance of the hearing aid, and wherein the device usage recommendation is provided during use of the hearing aid by the user;

at least one of: request feedback from the user about the device usage recommendation, or detect a device usage adjustment at the hearing aid;

in response to receiving the feedback from the user or detecting the device usage adjustment, update a set of device usage recommendation mappings wherein the device usage recommendation mappings comprise mappings based on detected on-head to off-head and off-head to on-head adjustments; and providing the device usage recommendation to the user based on the mappings as a recommendation to re-mount or adjust fit inserts for the hearing aid in response to detecting an off-head count that exceeds a threshold during a period.

10. The hearing aid of claim 9, wherein providing the device usage recommendation comprises applying the set of device usage recommendation mappings to data about at least one of: the operating state of the hearing aid, the usage pattern or the characteristic of the ambient acoustic signals, to select the device usage recommendation, wherein the device usage recommendations comprise mappings between:

at least one of: operating states of the hearing aid, usage patterns for the hearing aid or acoustic signatures of ambient acoustic signals; and device usage recommendations.

11. The hearing aid of claim 9, further comprising a display, wherein the device usage recommendation is provided at the display located at the hearing aid or on a distinct display at a smart device connected with the hearing aid during use of the hearing aid by the user.

12. The hearing aid of claim 9, wherein the operating state is defined by at least one of: an on/off state of the hearing aid, or an operating mode of the hearing aid while in the on state, wherein the operating mode is defined by a time spent in the operating mode and a user adjustment to a setting in the operating mode, and wherein the device usage adjustment comprises a user adjustment between operating modes or a user adjustment to a setting within an operating mode.

13. The hearing aid of claim 9, wherein the device usage recommendation comprises a suggested corrective action to adjust a behavior of the user or adjust a setting on the hearing aid, wherein the device usage recommendation mappings are further updated based upon usage pattern data for a population of users distinct from the user, wherein the control circuit is further configured to provide a notification indicating availability of the device usage recommendation, wherein the notification and the device usage recommendation are provided using at least one of: a visual interface, a tactile interface or an audio interface, and wherein the user provides the feedback at one or more of the visual interface, the tactile interface, the audio interface, or with a gesture-based command, and wherein the notification indicating availability of the device usage recommendation is provided during a period in which active conversation is detected at the hearing aid.

14. A computer-implemented method comprising:

providing a device usage recommendation to a user of a hearing aid based upon at least one of: an operating state of the hearing aid, a usage pattern for the hearing aid, or a characteristic of ambient acoustic signals detected at the hearing aid, wherein the device usage recommendation comprises a suggested corrective action provided as an interface notification to: improve audibility of target ambient acoustic signals for the user, or enhance performance of the hearing aid, and wherein the device usage recommendation is provided during use of the hearing aid by the user;

at least one of: requesting feedback from the user about the device usage recommendation, or detecting a device usage adjustment at the hearing aid; and in response to receiving the feedback from the user or detecting the device usage adjustment, updating a set of device usage recommendation mappings, wherein the device usage recommendation mappings comprise mappings based on: a) whether the hearing aid is detected as on the head of the user, b) whether audio is currently being played back at the hearing aid, and c) whether the hearing aid is detected as being in a noisy environment, wherein the device usage recommendation mappings further comprise mappings based on whether the hearing aid currently has a directivity function engaged, wherein the method further comprises providing the device usage recommendation to the user based on the mappings as a recommendation to:

i) move closer to a conversation partner in response to detecting that the hearing aid is on the head of the user, that audio is not currently being played back at the hearing aid, that the hearing aid is in a noisy environment, and that the directivity function is engaged, or ii) engage the directivity function in response to detecting that the hearing aid is on the head of the user, that audio is not currently being played back at the hearing aid, that the hearing aid is in a noisy environment, and that the directivity function is not engaged.

15. The method of claim 14, further comprising providing a notification indicating availability of the device usage recommendation.

* * * * *